US006975284B1

(12) United States Patent
Kim et al.

(10) Patent No.: US 6,975,284 B1
(45) Date of Patent: Dec. 13, 2005

(54) STRUCTURE AND DRIVING METHOD OF PLASMA DISPLAY PANEL

(75) Inventors: Jin Young Kim, Taegu-shi (KR); Seong Ho Kang, Taegu-shi (KR)

(73) Assignee: LG Electronics Inc., Seoul (KR)

( * ) Notice: Subject to any disclaimer, the term of this patent is extended or adjusted under 35 U.S.C. 154(b) by 592 days.

(21) Appl. No.: 09/695,976

(22) Filed: Oct. 26, 2000

(30) Foreign Application Priority Data

Oct. 28, 1999 (KR) ..... 1999-47167

(51) Int. Cl.[7] ..... G09G 3/28
(52) U.S. Cl. ..... 345/60; 345/66
(58) Field of Search ..... 345/60, 67, 66, 345/68, 63, 62, 64, 65; 315/169.4, 169.1; 375/584, 585, 586; 313/582, 584, 586

(56) References Cited

U.S. PATENT DOCUMENTS 5,210,468 A * 5/1993 Yoshioka ..... 315/169.4
5,212,472 A * 5/1993 Takahashi et al. ..... 345/60
5,661,500 A * 8/1997 Shinoda et al. ..... 313/485
5,835,072 A * 11/1998 Kanazawa ..... 345/60
5,990,630 A * 11/1999 Nakamura ..... 315/169.1
6,011,355 A * 1/2000 Nagai ..... 315/169.3
6,034,482 A * 3/2000 Kanazawa et al. ..... 315/169.1
6,118,214 A * 9/2000 Marcotte ..... 313/582
6,124,849 A * 9/2000 Ito et al. ..... 315/169.2
6,140,984 A * 10/2000 Kanazawa et al. ..... 315/169.4
6,175,194 B1 * 1/2001 Saegusa et al. ..... 315/169.4
6,195,072 B1 * 2/2001 Iwami et al. ..... 345/67
6,236,165 B1 * 5/2001 Ishizuka ..... 315/169.1
6,369,781 B2 * 4/2002 Hashimoto et al. ..... 315/169.4
6,373,452 B1 * 4/2002 Ishii et al. ..... 315/169.4
6,426,732 B1 * 7/2002 Makino ..... 345/68
6,428,377 B1 * 8/2002 Choi ..... 445/24
6,433,741 B2 * 8/2002 Tanizaki et al. ..... 313/483
6,456,265 B1 * 9/2002 Mikoshiba et al. ..... 345/66
6,483,251 B2 * 11/2002 Setoguchi et al. ..... 315/169.4
6,597,334 B1 * 7/2003 Nakamura ..... 345/68

FOREIGN PATENT DOCUMENTS

JP 08-096714 4/1996 ..... H01J 11/00
JP 8096714 4/1996
JP 10222120 A * 2/1997
JP 09-245627 9/1997 ..... H01J 9/02

* cited by examiner

*Primary Examiner*—Amare Morgistu
*Assistant Examiner*—Nitin Patel
(74) *Attorney, Agent, or Firm*—Fleshner & Kim, LLP

(57) ABSTRACT

A structure and driving method of a plasma display panel is provided, in which an amount of priming particles within a discharge cell increases to reduce discharge lag of address discharge. The structure of the plasma display panel includes a plurality of sustain electrode pairs successively formed on an upper electrode, a plurality of common electrodes formed one by one between a pair of the sustain electrodes, and a dielectric layer formed on the substrate to deposit the sustain electrodes and the common electrodes. The method for driving the plasma display panel includes the steps of applying a common pulse, which is periodically turned on/off, to the common electrodes, applying a scan pulse to one of a pair of the sustain electrodes, and applying an address pulse to the address electrodes when the scan pulse is applied to the one sustain electrode. Thus, since discharge conditions within the discharge cell can be improved, discharge lag less occurs than the related art plasma display panel.

21 Claims, 9 Drawing Sheets

STRUCTURE AND DRIVING METHOD OF PLASMA DISPLAY PANEL

BACKGROUND OF THE INVENTION

1. Field of the Invention

The present invention relates to a plasma display panel, and more particularly to a structure and driving method of a plasma display panel.

2. Discussion of the Related Art

Generally, a plasma display panel has higher definition than a cathode ray tube (CRT), various sized screens, and a thin thickness. In this respect, the plasma display panel has lately attracted considerable attention as the most practical next generation display of flat panel displays. Also, since the plasma display panel has a weight of ⅓ of a CRT having the same sized screen, a large sized panel of 40 inch to 60 inch can thinly be fabricated at a thickness of 10 cm or below.

The CRT and a liquid crystal display device are limited by their sizes when digital data and full motion are displayed at the same time. However, the plasma display panel does not have such a problem. Furthermore, the CRT may be affected by magnetic force. However, the plasma display panel is not susceptible to magnetic force, thereby providing stable images to viewers. Moreover, since each pixel of the plasma display panel is digitally controlled, image distortion of corners on a screen does not occur. Thus, the plasma display panel can provide higher picture quality than the CRT.

The plasma display panel includes two glass substrates coated with electrodes, and a gas sealed between the glass substrates. The electrodes formed in the glass substrates oppose each other in vertical direction, and pixels are formed in crossing portions of the electrodes.

A related art plasma display panel of three-electrode area discharge type will be described with reference to the accompanying drawings.

As shown in FIG. 1*a*, the related art plasma display panel of three-electrode area discharge type includes an upper substrate 10 and a lower substrate 20 which face each other. FIG. 1*b* shows a sectional structure of the plasma display panel shown in FIG. 2, in which the lower substrate 20 is rotated by 90°.

The upper substrate 10 includes scan electrodes 16 and 16', sustain electrodes 17 and 17', a dielectric layer 11, and a protection layer 12. The scan electrodes 16 and 16' are formed in parallel to the sustain electrodes 17 and 17'. The dielectric layer 11 is deposited on the scan electrodes 16 and 16' and the sustain electrodes 17 and 17'.

The lower substrate 20 includes an address electrode 22, a dielectric film 21 formed on an entire surface of the substrate including the address electrode 22, an isolation wall 23 formed on the dielectric film 21 between the address electrodes, and a phosphor 24 formed on surfaces of the isolation wall 23 in each discharge cell and of the dielectric film 21. Inert gases such as He and Xe are mixed in a space between the upper substrate 10 and the lower substrate 20 at a pressure of 400 to 600 Torr. The space forms a discharge area.

The scan electrodes 16 and 16' and the sustain electrodes 17 and 17' are of transparent electrodes and bus electrodes of metals so as to increase optical transitivity of each discharge cell, as shown in FIGS. 2*a* and 2*b*. That is to say, the electrodes 16 and 17 are of transparent electrodes while the electrodes 16' and 17' are of bus electrodes.

FIG. 2*a* is a plane view of the sustain electrodes 17 and 17' and the scan electrodes 16 and 16', and FIG. 2*b* is a sectional view of the sustain electrodes 17 and 17' and the scan electrodes 16 and 16'.

A discharge voltage from an externally provided driving integrated circuit (IC) is applied to the bus electrodes 16' and 17'. The discharge voltage applied to the bus electrodes 16' and 17' is applied to the transparent electrodes 16 and 17 to generate discharge between the adjacent transparent electrodes 16 and 17. The transparent electrodes 16 and 17 have an overall width of about 300 $\mu$m and are made of indium oxide or tin oxide. The bus electrodes 16' and 17' are formed of a three-layered thin film of Cr—Cu—Cr. At this time, the bus electrodes 16' and 17' have a line width of ⅓ of a line width of the transparent electrodes 16 and 17.

FIG. 3 is a wiring diagram of scan electrodes ($S_{m-1}$, $S_m$, $S_{m+1}$, . . . , $S_{n-1}$, $S_n$, $S_{n+1}$) and sustain electrodes ($C_{m-1}$, $C_m$, $C_{m+1}$, . . . , $C_{n-1}$, $C_n$, $C_{n+1}$) arranged on the upper substrate. In FIG. 3, the scan electrodes are insulated from one another while the sustain electrodes are connected in parallel. Particularly, a block indicated by a dotted line in FIG. 3 shows an active area where an image is displayed and the other blocks show inactive areas where an image is not displayed. The scan electrodes arranged in the inactive areas are generally called dummy electrodes 26. The number of the dummy electrodes 26 are not specially limited.

The operation of the aforementioned AC type plasma display panel of three-electrode area discharge type will be described with reference to FIGS. 4*a* to 4*d*.

If a driving voltage is applied between the address electrodes and the scan electrodes, opposite discharge occurs between the address electrodes and the scan electrodes as shown in FIG. 4*a*. The inert gas injected into the discharge cell is instantaneously excited by the opposite discharge. If the inert gas is again transited to the ground state, ions are generated. The generated ions or some electrons of quasi-excited state come into collision with a surface of the protection layer as shown in FIG. 4*b*. The collision of the electrons secondarily discharges electrons from the surface of the protection layer. The secondarily discharged electrons come into collision with a plasma gas to diffuse the discharge. If the opposite discharge between the address electrodes and the scan electrodes ends, wall charges having opposite polarities occur on the surface of the protection layer on the respective address electrodes and the scan electrodes, as shown in FIG. 4*c*.

If the discharge voltages having opposite polarities are continuously applied to the scan electrodes and the sustain electrodes and at the same time the driving voltage applied to the address electrodes is cut off, area discharge occurs in a discharge area on the surfaces of the dielectric layer and the protection layer due to potential difference between the scan electrodes and the sustain electrodes as shown in FIG. 4*d*. The electrons in the discharge cell come into collision with the inert gas in the discharge cell due to the opposite discharge and the area discharge. As a result, the inert gas in the discharge cell is excited and ultraviolet rays having a wavelength of 147 nm occur in the discharge cell. The ultraviolet rays come into collision with the phosphors surrounding the address electrodes and the isolation wall so that the phosphors are excited. The excited phosphors generate visible light rays, and the visible light rays display an image on a screen.

One pixel includes a discharge cell having a red phosphor, a discharge cell having a green phosphor, and a discharge cell having a blue phosphor. Contrast of an image displayed in the plasma display panel is controlled by the number of times of discharge in each discharge cell.

In the plasma display panel, priming effect is used to generate discharge in each discharge cell. In this case, priming particles, such as free electrons, ions, and quasi-stable atoms, are required. If electric field is sufficiently applied to the electrons, movement of the electrons is accelerated. When the electrons accelerated at a constant speed or greater come into collision with gas atoms or quasi-stable gas atoms, the gas atoms or the quasi-stable gas atoms can be ionized. Then, there are separated electrons and ions. The separated electrons are accelerated again by the electric field.

The sufficiently accelerated electrons come into collision with other gas atoms. In this case, another ionization may occur.

The ions are accelerated in opposition direction to the electrons. When the ions come into collision with a protection layer of MgO at a cathode, secondary electrons are discharged. The secondary electrons are accelerated by the electric field and come into collision with other gas atoms. In this case, the number of the electrically separated electrons gradually increases. If the number of the secondary electrons generated by collision of ions with the protection layer increases, the number of the gas atoms to be ionized increases. As a result, flow of the electrons or ions rapidly increases. This is called discharge.

At this time, it takes about several hundreds of ns or several $\mu$s to reach discharge after applying the electric field. This is called a discharge lag. The discharge lag includes a statistic time lag and a formative time lag. The formative time lag is caused by some factors such as kinds and pressure of gas, a structure of a cell, and discharge coefficient of the secondary electrons of the protection layer. The discharge lag is concerned in a width of a pulse for driving of the plasma display panel.

The formative time lag is generally within the range of several hundreds of ns while the statistic time lag is within the range of several hundreds of ns to several $\mu$s. If the priming particles exist at a sufficient concentration, the statistic time lag is set within several hundreds of ns. However, if the priming particles do not exist at a sufficient concentration, delay may occur for 3 $\mu$s to 4 $\mu$s. The most priming particles exist directly after discharge. The number of the priming particles is reduced as they are diffused to the discharge space, recombined, excited, and transited to the ground state.

The concentration of the priming particles from the time when discharge occurs to 30 $\mu$s does not affect the statistic time lag of the next discharge. However, the concentration of the priming particles after 30 $\mu$s has elapsed affects the statistic time lag of the next discharge.

For address discharge, if pulses are applied to the scan electrodes and the address electrodes, the discharge is completed within a desired time (generally, 3 $\mu$s) where the priming particles exist sufficiently. Thus, wall charges occur sufficiently. However, in the related art plasma display panel, it is likely that the priming particles do not exist sufficiently and thus the discharge is not completed within a desired time. In this case, address discharge may not occur in the discharge cell. This is called addressing failure or mis writing.

As described above, the related art plasma display panel has several problems.

Discharge lag is not constant due to deficiency of the priming particles for use in the priming effect. This could lead to address failure. Accordingly, to sufficiently generate wall charges, it is necessary to widen the width of the scan pulse applied to the scan electrodes at a constant level or greater. In this case, a problem arises in that a sustain time period is reduced if resolution becomes higher.

SUMMARY OF THE INVENTION

Accordingly, the present invention is directed to a structure and driving method of a plasma display panel that substantially obviates one or more of the problems due to limitations and disadvantages of the related art.

An object of the present invention is to provide a structure and driving method of a plasma display panel in which an amount of priming particles within a discharge cell increases to reduce discharge lag of address discharge, thereby reducing a width of an address pulse and fabricating a plasma display panel of high resolution.

Additional features and advantages of the invention will be set forth in the description which follows, and in part will be apparent from the description, or may be learned by practice of the invention. The objectives and other advantages of the invention will be realized and attained by the scheme particularly pointed out in the written description and claims hereof as well as the appended drawings.

To achieve these and other advantages and in accordance with the purpose of the present invention, as embodied and broadly described, a plasma display panel according to the present invention includes a plurality of sustain electrode pairs successively formed on an upper electrode, a plurality of common electrodes formed one by one between a pair of the sustain electrodes, and a dielectric layer formed on the substrate to deposit the sustain electrodes and the common electrodes.

It is to be understood that both the foregoing general description and the following detailed description are exemplary and explanatory and are intended to provide further explanation of the invention as claimed.

BRIEF DESCRIPTION OF THE DRAWINGS

The invention will be described in detail with reference to the following drawings in which like reference numerals refer to like elements wherein.

DETAILED DESCRIPTION OF THE PREFERRED EMBODIMENTS

Reference will now be made in detail to the preferred embodiments of the present invention, examples of which are illustrated in the accompanying drawings.

Figure 1A:
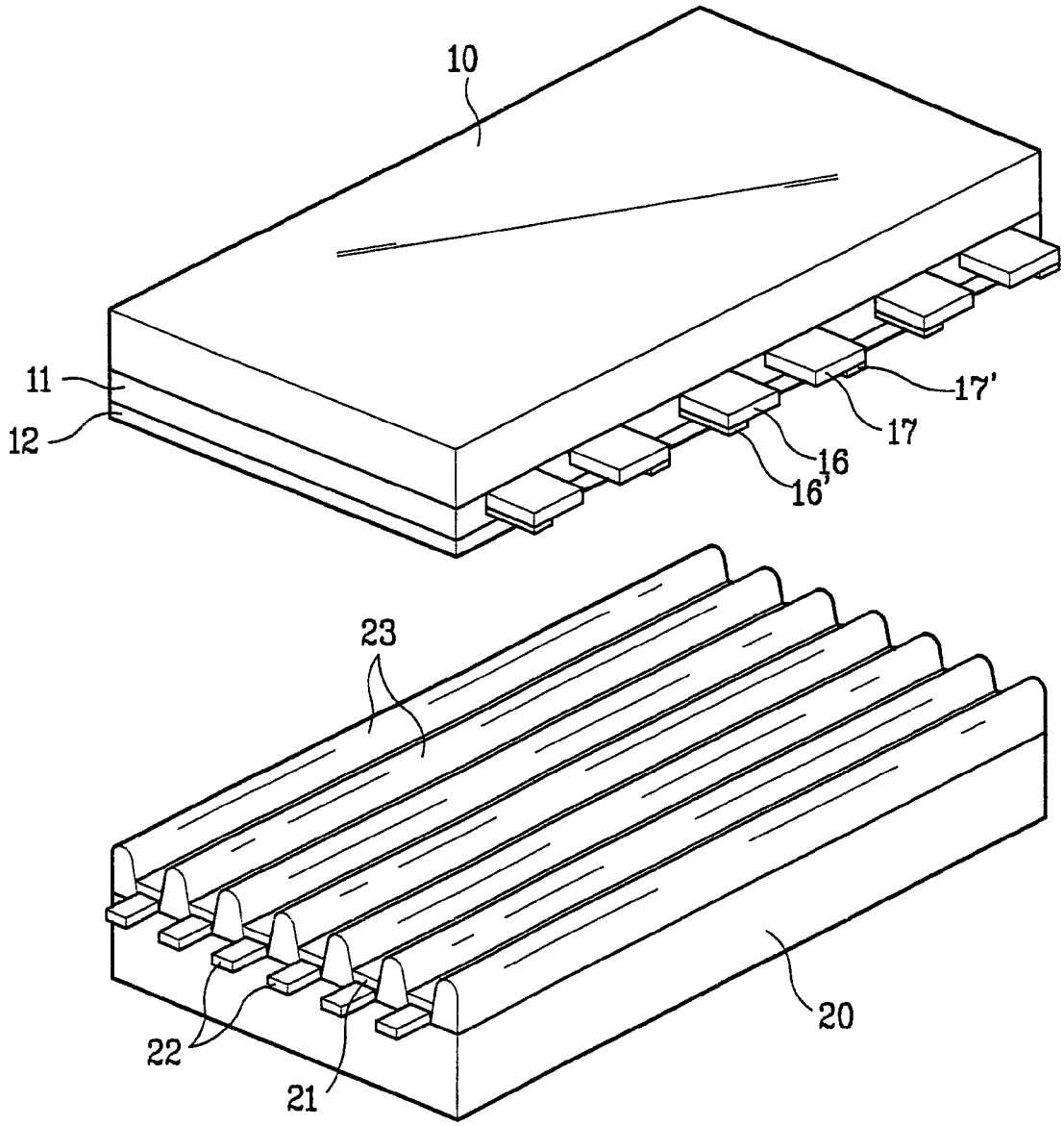
RELATED ART FIG.1A
FIGS. 1*a* and 1*b* are a sectional view and a plane view showing a structure of a general plasma display panel.
Figure 1B:
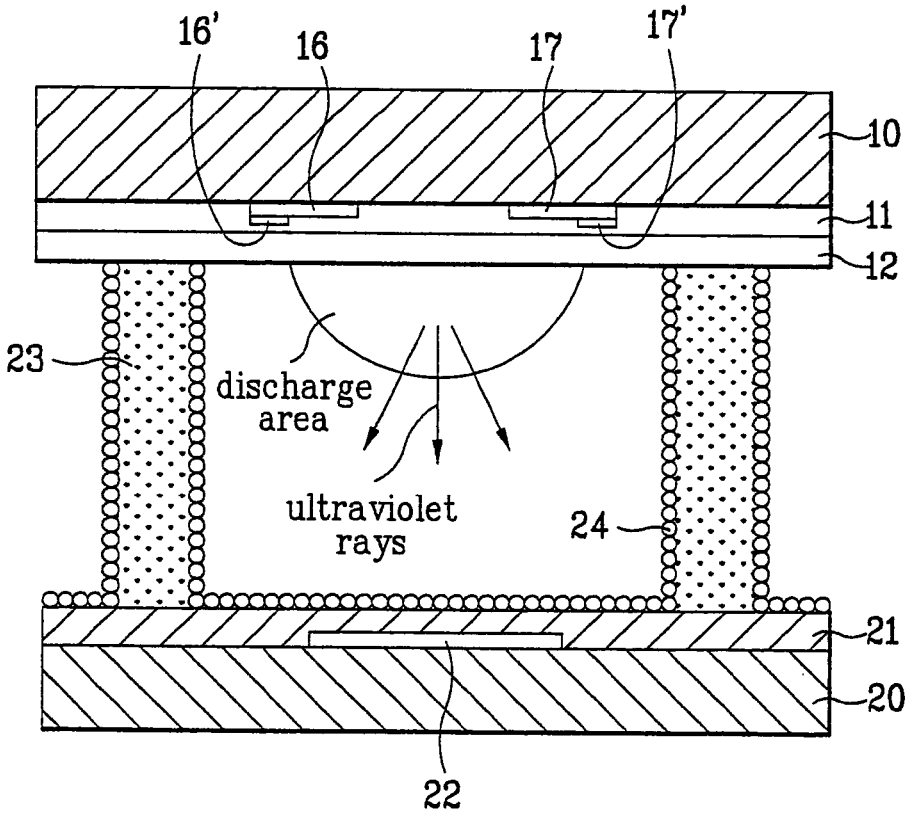
RELATED ART FIG.1B
Figure 2A:
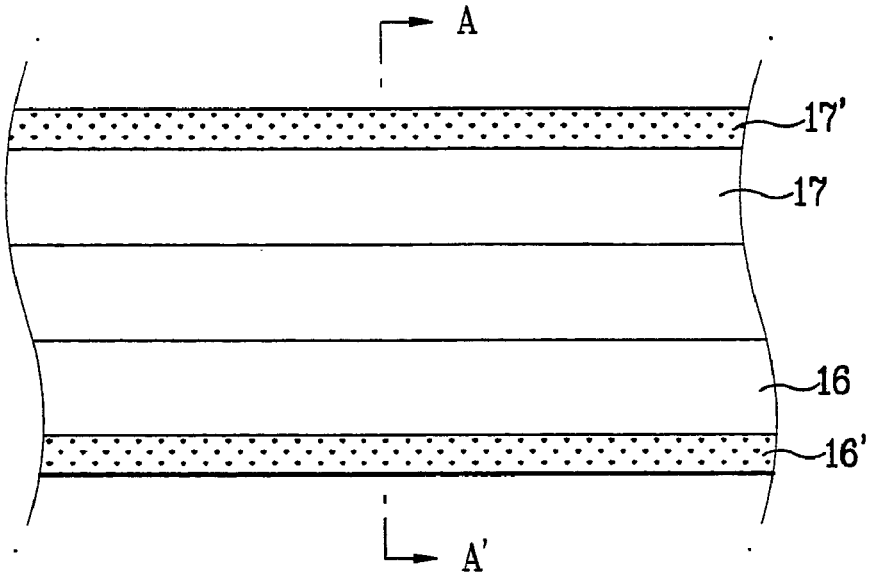
RELATED ART FIG.2A
FIGS. 2*a* and 2*b* are plane views showing scan electrodes and sustain electrodes of the plasma display panel.
Figure 2B:
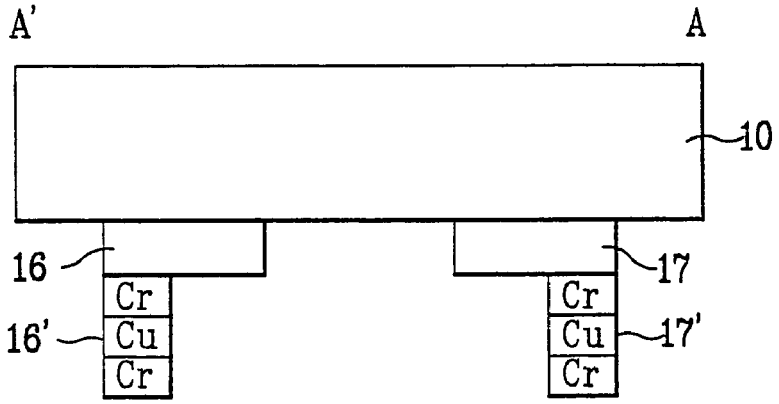
RELATED ART FIG.2B
Figure 3:
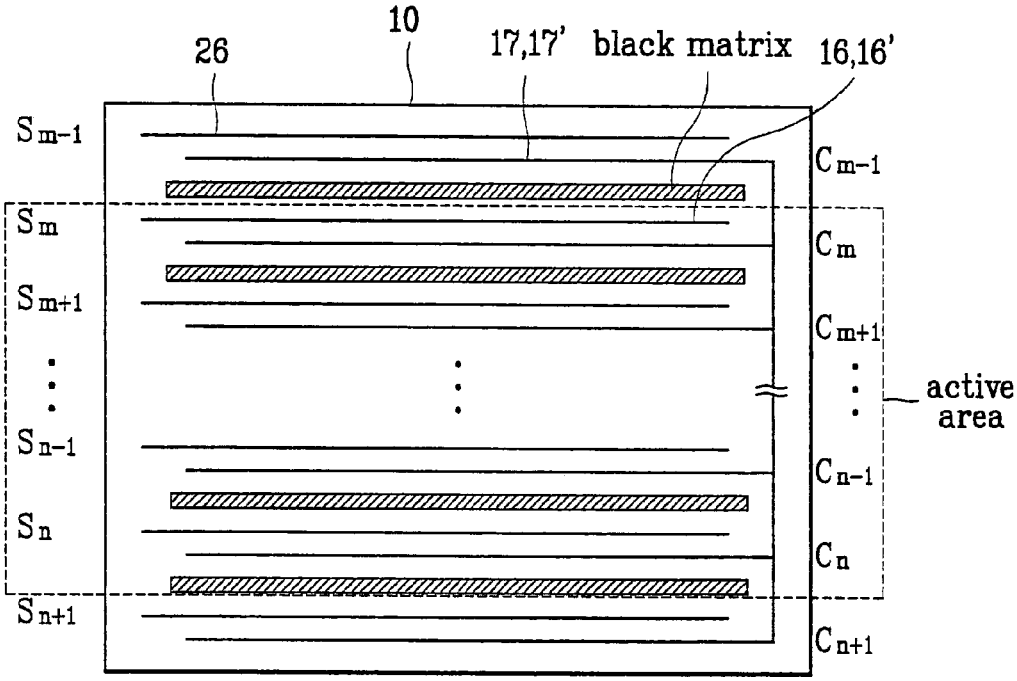
RELATED ART FIG.3
FIG. 3 is a plane view showing wiring of the scan electrodes and sustain electrodes of the plasma display panel.
Figure 4A:
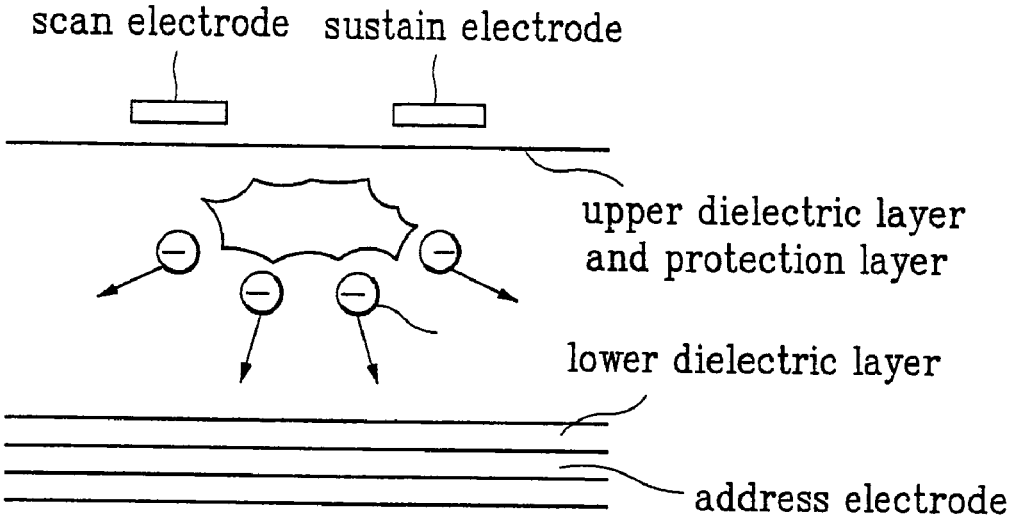
RELATED ART FIG. 4A
FIGS. 4*a* to 4*d* are sectional views showing discharge principles of the plasma display panel.
Figure 4B:
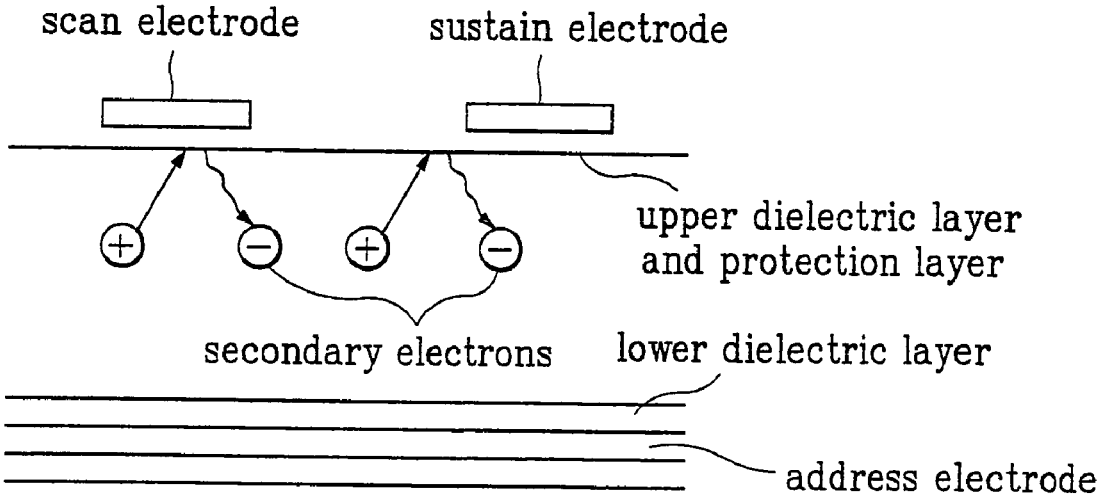
FIG. 4B RELATED ART
Figure 4C:
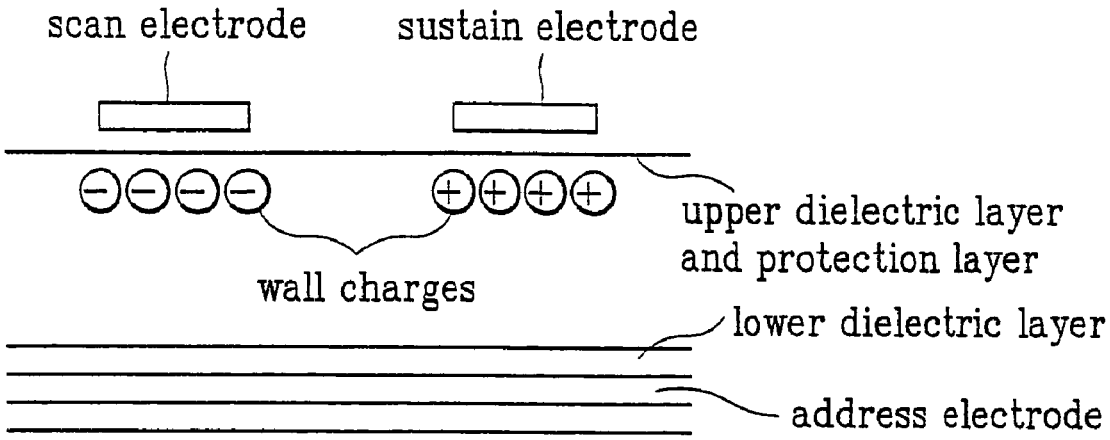
RELATED ART FIG. 4C
Figure 4D:
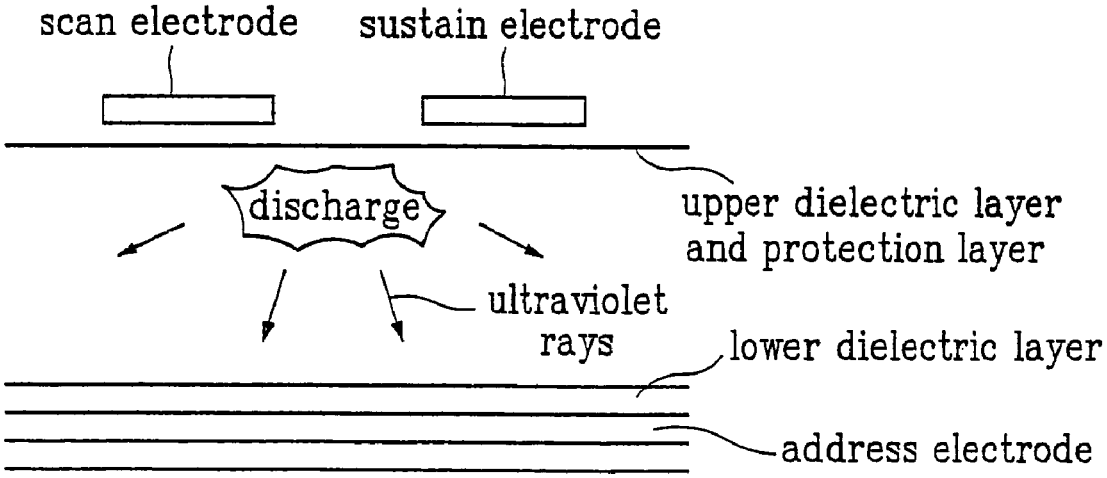
FIG. 4D RELATED ART
Figure 5:
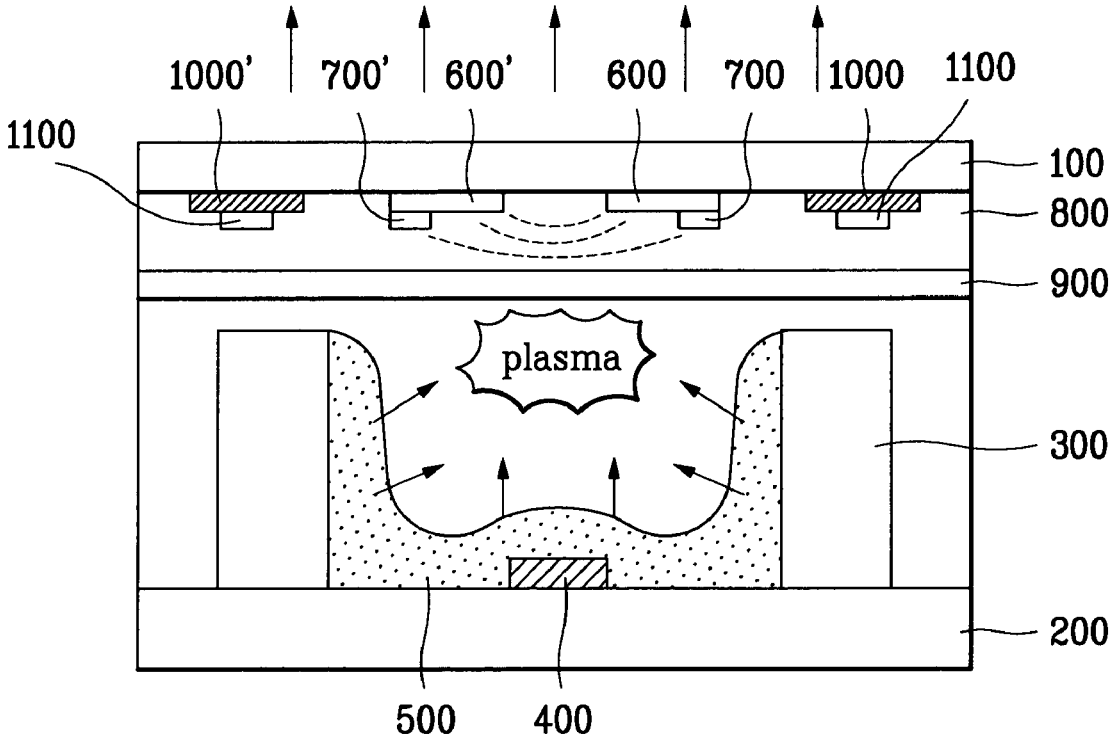
FIG. 5 is a sectional view showing a plasma display panel according to the present invention.

As shown in FIG. 5, a plasma display panel of the present invention includes a plurality of sustain electrodes, and a plurality of common electrodes formed between the respective sustain electrodes. A dielectric layer 800 is formed on an entire surface of an upper substrate 100 to deposit the sustain electrodes and the common electrodes 1100 and 1100'. The dielectric layer 800 is deposited within the range of 10 $\mu$s to 45 $\mu$s. A protection layer 900 of MgO is formed on the dielectric layer 800.

Figure 6A:
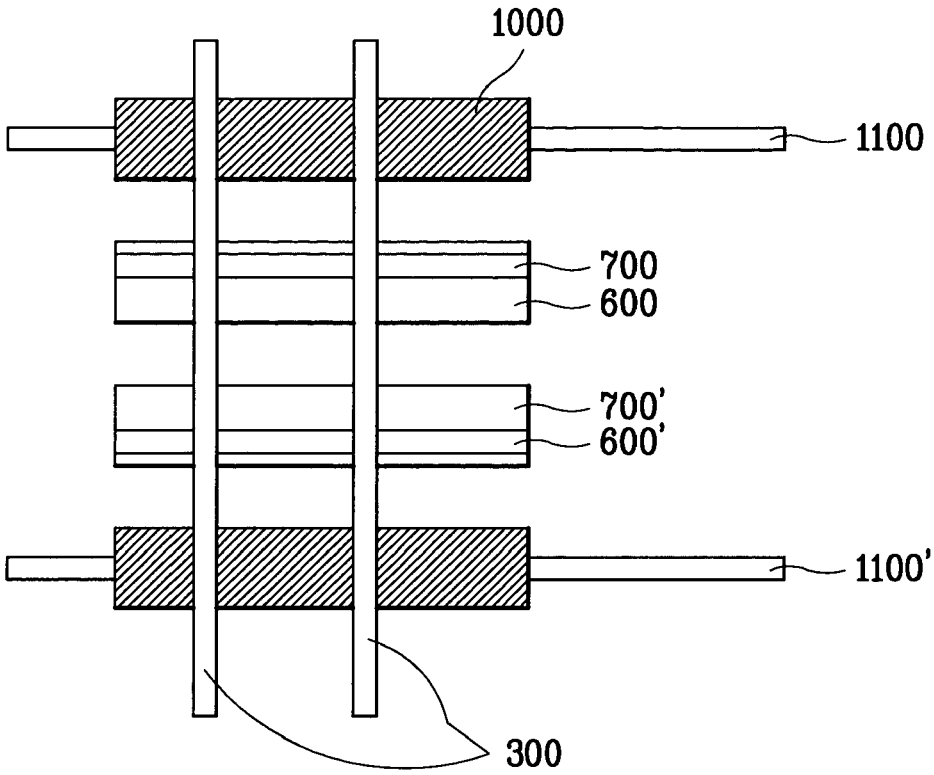
FIGS. 6*a* and 6*b* are plane views showing a structure of electrodes and their connection state of the plasma display panel according to the present invention.

As shown in FIG. 6*a*, the sustain electrodes include sustain electrodes 600 and 700 to which sustain discharge voltages are applied, and scan electrodes 600' and 700' to which the sustain discharge voltages and scan pulses are applied. The sustain electrodes 600 and 700 and the scan electrodes 600' and 700' are formed of discharge electrodes 600 and 600' of transparent electrodes and bus electrodes 700 and 700' of metal electrodes. A driving voltage is applied from an external driving circuit (not shown) to the sustain electrodes 600 and 700 and the scan electrodes 600' and 700' through the bus electrode having low resistance. At this time, voltage difference occurs between discharge electrodes of a pair of different sustain electrodes adjacent to each other due to the driving voltage applied through the bus electrode. The voltage difference causes plasma discharge within the discharge cell.

Common electrodes 1100 and 1100' are formed one by one between a pair of the sustain electrodes. That is, the respective common electrodes 1100 and 1100' are formed to divide the sustain electrodes in pairs. Each of the common electrodes 1100 and 1100' is formed of a three-layered metal thin film of Cr, Cu, and Cr sequentially deposited on the upper substrate 100. Alternatively, each of the common electrodes 1100 and 1100' may be formed of a single layer of Ag. Address electrodes 300 are formed to cross the sustain electrodes and the common electrodes.

Figure 6B:
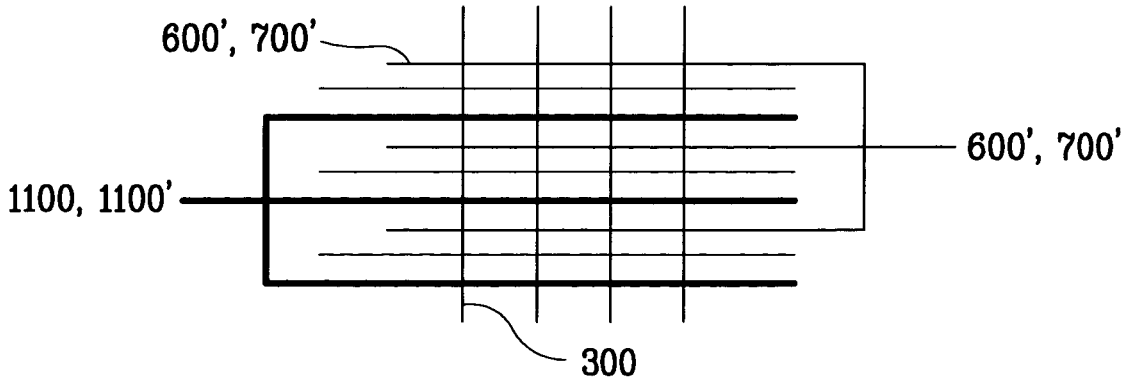

At this time, as shown in FIG. 6*b*, the common electrodes 1100 and 1100' are commonly connected to a common node in an outer region of the upper substrate 100. The same common pulse is applied to the common electrodes 1100 and 1100' through the external driving circuit.

Weak discharge may occur due to the common electrodes. To prevent picture quality of the plasma display panel from being affected by the weak discharge, black matrixes 1000 and 1000' may be formed between the upper substrate 100 and the common electrodes 1000 and 1000'. The black matrixes 1000 and 1000' may be formed on a rear surface of the upper substrate 100 on which the electrodes are formed.

The operation of the plasma display panel according to the present invention will be described below.

Figure 7:
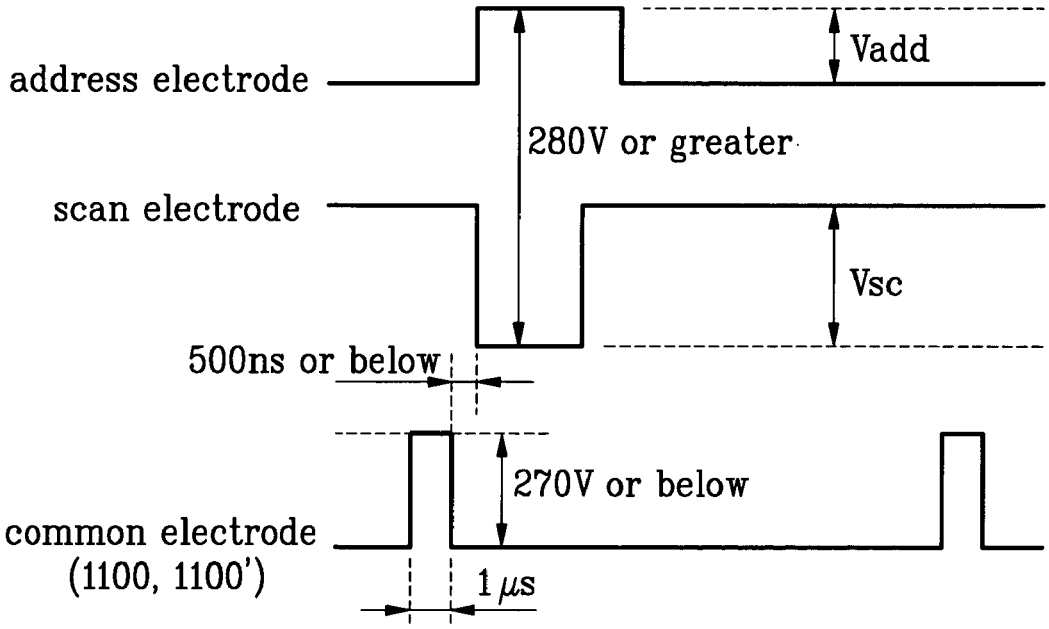
FIG. 7 is a waveform showing a voltage pulse applied to the plasma display panel according to the present invention.

FIG. 7 is a waveform showing a voltage pulse applied to the common electrodes 1100 and 1100' and the sustain electrodes of the plasma display panel according to the present invention.

A common pulse which periodically repeats high level and low level is applied to the common electrodes 1100 and 1100'. The high level potential of the common pulse is lower than a discharge start voltage of the plasma display panel. Preferably, the high level potential of the common pulse is about 270V or below. Also, the width of the common pulse, particularly, a high level section in one period is preferably set within the range of 1 $\mu$s or below.

After the high level section of the common pulse ends, a scan pulse is applied to the scan electrode of a pair of the sustain electrodes with some delay time. At the same time, an address pulse is applied to the address electrode when the scan pulse is applied to the scan electrode. At this time, the maximum potential difference between the scan pulse and the address pulse is greater than the discharge start voltage of the plasma display panel. Preferably, the maximum potential difference is set at about 280V or greater.

Furthermore, the delay time is preferably 500 ns or below. Namely, the time difference between the time when the high level of the common pulse is turned off and the time when the scan pulse is turned on, or the time difference between the time when the high level of the common pulse is turned off and the time when the address pulse is turned on is set at 500 ns or below.

At this time, the on-state of the scan pulse may be high level or low level. That is, the scan pulse or the address pulse is preferably set to have the maximum potential difference between them during on period regardless of their level state.

The discharge principles of the plasma display panel operated as above will now be described.

If the common pulse is applied to the common electrodes 1100 and 1100', discharge does not occur within the discharge cell but strong electric field is formed by a voltage of the common pulse. The strong electric field forms priming particles within the discharge cell so as to improve discharge conditions within the discharge cell.

Afterwards, the address pulse and the scan pulse are applied to the respective electrodes with a predetermined delay time so that address discharge occurs within the discharge cell. At this time, the delay time is preferably set within the range that the priming particles generated by the common pulse are not erased. The delay time is preferably set at about 500 ns.

As aforementioned, the plasma display panel according to the present invention has the following advantages.

Since the discharge conditions within the discharge cell can be improved by the common pulse, discharge lag less occurs than the related art plasma display panel. Accordingly, the width of the sustain pulse for sustain discharge is more reduced than the related art. This could lead to fabrication of a plasma display panel having higher resolution than the related art. Moreover, since the sustain period which sustains light-emission during driving operation can be increased, higher luminance can be achieved.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A plasma display panel comprising:

a plurality of sustain electrodes pairs successively formed on an upper electrode;

a plurality of priming electrodes configured to increase the amount of priming particles in a discharge cell to reduce discharge lag formed one by one between a pair of the sustain electrodes; and a dielectric formed on the substrate to deposit the sustain electrodes and the priming electrodes wherein the plurality of sustain electrodes pairs comprise a first electrode and a second electrode; and each first electrode is commonly connected.

2. The plasma display panel of claim 1, wherein the priming electrodes are commonly connected to a common node.

3. The plasma display panel of claim 1, wherein the priming electrodes are formed of a three-layered structure of Cr, Cu, and Cr sequentially deposited on the substrate.

4. The plasma display panel of claim 1, wherein the priming electrodes are formed of Ag.

5. The plasma display panel of claim 1, wherein the dielectric layer has a thickness of 10 $\mu$m to 30 $\mu$m.

6. The plasma display panel of claim 1, further comprising black matrixes formed between the substrate and the priming electrodes.

7. The plasma display panel of claim 1, wherein the sustain electrode pairs are different structures than the priming electrodes.

8. The plasma display panel of claim 1, further comprising a plurality of scan electrode pairs formed on the upper electrode different from the sustain electrode pairs and the priming electrodes.

9. The plasma display panel of claim 1, wherein the plasma display panel comprise an AC-type plasma display panel.

10. A method for driving a plasma display panel which includes a plurality of sustain electrode pairs successively formed on a substrate, a plurality of priming electrodes configured to increase the amount of priming particles in a discharge cell to reduce discharge lag, wherein the priming electrodes are between a pair of the sustain electrodes, and a plurality of address electrodes formed to cross the sustain electrodes, wherein the plurality of sustain electrodes pairs comprise a first electrode and a second electrode; and each first electrode is commonly connected, the method comprising the step of:

applying a common pulse, which is periodically turned on/off, to the priming electrodes;

applying a scan pulse to one of a pair of the sustain electrodes; and applying an address pulse to the address electrodes when the scan pulse is applied to the one sustain electrode.

11. The method of claim 10, wherein the potential difference between on/off-periods of the common pulse is lower than a discharge start voltage of the plasma display panel.

12. The method of claim 11, wherein the potential difference is 270V or below.

13. The method of claim 10, wherein a width of the common pulse in the on-period is 1 $\mu$s or below.

14. The method of claim 10, wherein the maximum potential difference between the scan pulse and the address pulse is more than the discharge start voltage of the plasma display panel.

15. The method of claim 10, wherein the maximum potential difference between the scan pulse and the address pulse is more than 280V.

16. The method of claim 10, wherein the time difference between the time when the common pulse is turned off and the time when the scan pulse is turned on is 500 ns or below.

17. The method of claim 10, wherein the time difference between the time when the common pulse is turned off and the time when the address pulse is turned on is 500 ns or below.

18. The method of claim 10, wherein the sustain electrode pairs are different structures than the priming electrodes.

19. The method of claim 10, further comprising a plurality of scan electrode pairs formed on the substrate different from the sustain electrode pairs and the priming electrodes.

20. The method of claim 10, wherein the common pulse is applied at a different time than the scan pulse and the address pulse.

21. The method of claim 10, wherein the plasma display panel comprises an AC-type plasma display panel.

* * * * *